US005920333A

United States Patent [19]

Bates

[11] Patent Number: 5,920,333

[45] Date of Patent: Jul. 6, 1999

[54] REPLENISHMENT OF RESERVOIRS

[75] Inventor: Christopher Michael Bates, Kettering, United Kingdom

[73] Assignee: Willett International Limited, United Kingdom

[21] Appl. No.: 08/976,921

[22] Filed: Nov. 24, 1997

Related U.S. Application Data

[63] Continuation of application No. 08/307,600, filed as application No. PCT/GB93/00556, Mar. 18, 1993, abandoned.

[30] Foreign Application Priority Data

Mar. 18, 1992 [GB] United Kingdom ..... 9205870

[51] Int. Cl.[6] ..... B41J 2/175

[52] U.S. Cl. ..... 347/85

[58] Field of Search ..... 347/85, 86; 141/383, 141/384, 386; 285/12, 24, 27, 914; 215/274, 243, 298, 332; 220/293, 297, 298

[56] References Cited

U.S. PATENT DOCUMENTS

| | | | |
|---|---|---|---|
| 1,937,982 | 5/1933 | Rudolph | 285/12 |
| 4,211,439 | 7/1980 | Moldestad | 285/914 |
| 4,665,960 | 5/1987 | Braezicki et al. | 141/386 |
| 4,708,370 | 11/1987 | Todd | 285/12 |
| 5,009,454 | 4/1991 | Bartholomew | 285/24 |

FOREIGN PATENT DOCUMENTS

| | | | |
|---|---|---|---|
| 61-284445 | 12/1986 | Japan | 347/86 |

*Primary Examiner*—N. Le
*Assistant Examiner*—Judy Nguyen
*Attorney, Agent, or Firm*—Charles D. Gunter, Jr.

[57] ABSTRACT

The present invention relates to a system for ensuring that the correct container (10) containing a replenishment fluid is connected to a vessel (26) for that fluid. The container carries one component (18) of a pair of axially engageable members (20). The other (28) is carried by the vessel (26, 27), notably around the necks extending therefrom, so that the members (20, 30) have to engage and nest so as to allow the necks of the container and the vessel to engage fully and thus mount the container on the vessel, one of the members (18, 28) being a moveable fit upon the container (10) or vessel (26), preferably by virtue of being a snap fit thereon, so that the member can be rotated to align its projections (20) with the recesses (30) on the other member. The invention is of especial application in ink jet printers to identify solvent and ink refill bottles and ensure that they are connected to the correct reservoir and by the use of the snap fit members allows a conventional refill bottle and reservoir to be used to achieve this.

5 Claims, 2 Drawing Sheets

REPLENISHMENT OF RESERVOIRS

This is a continuation of application Ser. No. 08/307,600, filed Apr. 17, 1995, now abandoned, which is a 371 of PCT/GB93/00556, filed Mar. 18, 1995.

The present invention relates to the replenishment of reservoirs, notably to a method of ensuring that the correct bottle or other source of replenishing ink or other fluid is fitted to a reservoir on a piece of equipment which has at least two reservoirs to be replenished with different substances supplied in replaceable containers.

BACKGROUND TO THE INVENTION

Some pieces of equipment, for example ink jet printers, have to be replenished with more than one fluid. For example these fluids may be an ink and a separate top-up fluid which is a solvent or carrier for the ink to adjust the viscosity of the ink during operation of the printer. The replenishment fluids are conventionally supplied in plastic bottles, metal flasks or other containers, the neck or outlet of which is secured into a corresponding socket at the inlet to the reservoir or other vessel holding the supply of that fluid for use in the equipment. For convenience the term container will be used herein to denote in general the bottle, flask, etc. in which the replenishment fluid is supplied to the equipment; and the term vessel will be used to denote the tank or other reservoir in which the fluid is stored in the equipment for use during the operation of the equipment.

The container and the vessel are often constructed so as to allow the replenishment fluid to flow from the container into the vessel once the outlet of the container has been seated home upon the inlet to the vessel, for example by having suitable engaging valve members. Where the equipment uses a number of different fluids, for example inks and solvents or different coloured inks in an ink jet printer, it is necessary to ensure that the correct container is fitted to the correct vessel to avoid contamination of one fluid with another and possible damage to the equipment, for example by feeding corrosive concentrated solvent through an ink line.

It has been proposed to colour code the cap or other closure of a container to identify the fluid contained therein and to colour code the vessels so that a user can readily see which container should be fitted to which vessel. However, this does not physically prevent the wrong container from being connected to a vessel, notably by a person who is colour blind.

It has therefore been proposed, as is acknowledged in U.S. Pat. No. 4,907,019, to form the neck of the container with a series of axial flutes which engage with axial slots formed in the inlet bore of the vessel, so that a container can only be fitted to a vessel having the corresponding slots. This provides a physical barrier to fitting the wrong container to the inlet of a vessel which does not have the corresponding slot configuration. An alternative form of such a construction is proposed in Japanese Patent Application No JP-A-61 284445 in which the inlet to the vessel has a rotatable central member which is shaped to fit into a corresponding orifice in the outlet of the container. However, such a structures require that the container outlets and the vessel inlets be especially manufactured to carry the appropriately shaped members and orifices, or flutes and slots, which adds to the cost and complexity of the equipment and restricts the freedom of a user to purchase replenishment fluids from alternative sources. Furthermore, if, as stated in the U.S. patent, a manufacturer produces a second generation of the equipment which requires a modified version of the replenishment fluid, it is necessary to structure the flutes/slots to prevent use of the first generation fluids on a second generation machine. In some cases the second generation fluids may be suitable for use in the first generation of machines, in which case it may be desirable to permit this by further permutations of the flute/slot arrangements.

The use of a flute/slot arrangement thus becomes complex and expensive and precludes alternative supply of fluids to an end user.

We have now devised a form of identification means which reduces the above problems.

SUMMARY OF THE INVENTION

Accordingly, the present invention provides a means for relating the identity of a container to a vessel to which the container is to be connected so as to discharge a replenishment fluid from the container to the vessel via an outlet from the container which engages with an inlet to the vessel, at least one of said inlet or outlet being carried on a neck member extending from the container and/or the vessel, and in which the said inlet and outlet are each to be provided with one component of a pair of inter-engaging members which require engagement before the container can be secured in fluid flow communication with the vessel, characterised in that: at least one of the interengaging members is provided as an annular member which is adapted be engaged in a moveable fit upon the said neck member.

Preferably, the inter-engaging members are provided as a ring or annular member mounted upon each neck member extending from the container and the vessel which carry the outlet and inlet respectively, one of the ring members carrying a circumferential or annular series of projections which engage in a corresponding series of recesses carried by the other ring member so that full axial engagement of the container with the vessel cannot be achieved until the projections engage with the recesses. In a particularly preferred embodiment, the ring member on the neck of the container is a snap fit upon the neck and is a rotatable fit upon the neck; whereby the ring member can be a snap fit post fitted accessory upon the neck of a conventional replenishment bottle or the like and allows the ring member to be rotated to align its projections with the recesses on the ring member carried by the vessel or vice versa and/or allows the container to be rotated once the projections and the recesses have been engaged so as to screw or bayonet mount the container on the vessel. Similarly, the ring member on the vessel can be a snap fit so that the whole of the container/vessel identification means can be provided as a separate accessory which is post fitted to conventional containers and vessels with little or no modification thereof so that a user can readily modify existing equipment to ensure that the correct replenishment container is fitted to the correct reservoir or other vessel.

It will be appreciated that the member carrying the projections can be carried by the vessel and the member carrying the recesses by the container or vice versa. Furthermore, the one of the members can be secured fixedly to the container and/or the vessel so that they become an integral part thereof, rather than being a snap fit or demountable fixing thereto. For convenience, the present invention will be described hereinafter in terms of a ring member carrying the projections which is fitted as a snap fit upon the neck of the container, with the ring or other member carried by the neck of the vessel being moulded integrally with the body and neck of the vessel during its manufacture.

However, it will be appreciated that the member carried by the vessel can be a snap fit upon the neck of the vessel to provide the recesses into which the projections on the ring member carried by the neck of the container are to engage.

The invention can be applied to a wide range of types of vessel and container. However, it is of especial application in securing the correct fitment of a plastic or similar bottle containing a replenishment solvent or ink to one of several reservoirs of such fluids in an ink jet printer, notably to ensure that an ink refill bottle is fitted to the ink reservoir whereas a solvent top up bottle is fitted to the solvent reservoir.

The invention therefore provides an ink jet printer containing at least two reservoirs each adapted to receive a fluid from a replenishment bottle, characterised in that the inlet to the reservoir carries one member of the identifying means of the invention and the neck of the replenishment bottle carries the other member of the identifying means.

Preferably each container ring member has at least one arm which extends parallel to the direction of coupling movement between the container and the vessel, and the ring on the neck of the vessel has a slot or slots corresponding in number and in angular spacing to the arm or arms on the container ring. Typically, the container and the vessel are coupled by axial movement of the container towards the vessel combined by rotation of the container so that a screw or bayonet mounting between the container and vessel can be achieved. The arms and slots or recesses therefore extend axially in such a form of mounting. However, the container may be mounted upon the vessel by transverse relative movement, as when the neck of the container has a radially extending lip or flange which engages in opposed slots carried by the neck of the vessel, in which case the inter-engaging members of the identifying means of the invention engage as the container and vessel move transversely. For convenience, the invention will be described hereinafter in terms of a container which is an axial screw or bayonet fit on the neck of the vessel and the ring member on the neck of the container permits relative rotation of the container and vessel to allow securing of the screw or bayonet mounting after the projections and recesses of the ring members engage. This feature is not possible with the fixed flute/slot design of the prior proposal and, coupled with the snap fit of the member onto the neck of the container provides a particularly versatile embodiment of the invention which can be applied to existing containers.

The ring members can carry one or more arms and corresponding slots, for example the ring member on the vessel can carry three equi-angularly spaced slots, and the ring member on the container will have three arms at corresponding positions so that the arms and slots are in register when the container is coupled to the vessel and the two ring members can nest axially to achieve foreshortening of the ring members to allow the container to be pushed or screwed fully home upon the vessel. It will be appreciated that the arms need not be carried upon only the one ring member and that it is within the scope of the present invention for a ring member to carry both arms and slots. The possible permutations of slots and arms to identify co-operating containers and vessels can thus be extended by varying the number and position of the slots and arms on either or both of the ring members to ensure that a specific container/vessel combination has a unique identifying arm/slot combination.

To further assist correct coupling of the container and vessel, the ring members and the closure cap for the containers and the inlet to the reservoir can be colour coded.

As indicated above, the coupling action between the container and the reservoir may be by an axial push or screw-in movement, with the container being inverted so that its neck is downwards as the coupling action takes place. Preferably, the neck of the container is closed by a frangible seal which is broken as the container is moved fully home onto or into the inlet of the vessel.

DESCRIPTION OF THE DRAWINGS

The invention will now be further described, by way of example, with reference to the accompanying drawings, in which.

DESCRIPTION OF THE PREFERRED EMBODIMENTS

Figure 1:
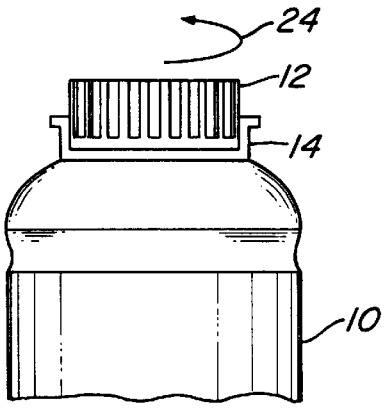
FIG. 1 shows the top of a fluid container in accordance with the invention.

A replenishment container 10 is shown in FIG. 1 with a screw top 12 and a ring member 14 around the neck of the container. The container contains a fluent material (either a fluid or a powder) which is to be charged to a reservoir on a piece of equipment, such as an ink jet printer. The cap 12 is screwed onto a threaded neck or outlet 16 (see FIG. 4), and the neck is sealed by an aluminium foil transverse membrane (not shown).

Figure 2:
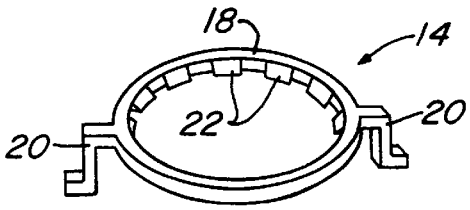
FIGS. 2 and 3 are respectively perspective and plan views of a ring member for use with the container of FIG. 1.
Figure 3:
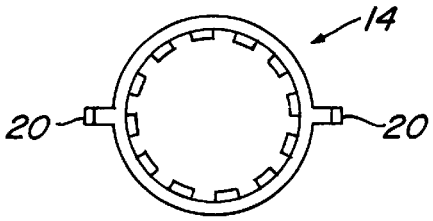

The ring 14 is shown in more detail in FIGS. 2 and 3. The ring consists of an annular portion 18 which surrounds the neck 16 of the container, and two diametrically opposed axially extending arms 20. The inside of the annular portion 18 has a series of teeth 22 which are shaped so that they act as a ratchet as the ring is pushed onto the container neck 16 over the threads on the neck so that they engage the threads and prevent ready removal of the ring once in place. The ring 14 preferably rotates freely around the neck 16, so that as the cap 12 is unscrewed (as indicated by an arrow 24) the ring 14 will also rotate so that it doe not obstruct the gripping of the cap 12 during unscrewing. Furthermore, where the container is secured on vessel 28 by a screw mounting, the rotation of ring 14 will allow the screw mounting to be achieved with ring 14 in place.

The arms 20 are radially offset from the annular portion 18 of the ring member to allow the cap 12 to fit fully onto the threaded neck 16. The arms 20 can have simple square-cut ends or can have transversely extending feet as shown which can be angled to assist engagement of the arms into the slots in the neck of the vessel as described below.

An ink jet printer consumes both top-up fluid and ink, and these fluids are contained in separate reservoirs 26, 27 which are mounted on the printer. These reservoirs have to be replenished from time to time as the fluids are used up, and it is conventional to supply the replenishment fluids in containers of the type shown in FIG. 1 which are stored, in a sealed condition, where they are accessible to the operator of the machine. To replenish the fluid, the appropriate container 10 is taken and the cap 12 is unscrewed and discarded. At this point the contents of the container are still sealed into the container by the aluminium foil across the end of the container neck.

Figure 4:
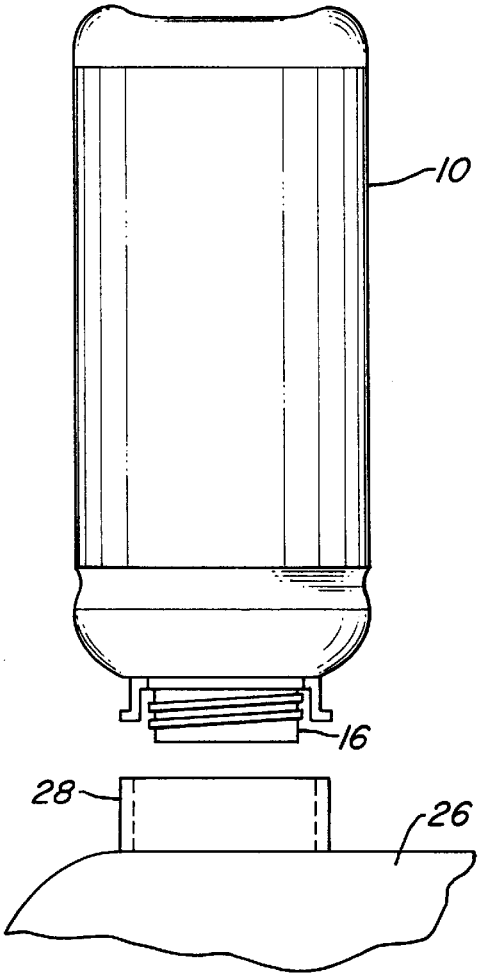
FIG. 4 shows the container of FIG. 1 with its screw closure cap removed and inverted over a reservoir to be replenished from the container.

The container is then inverted as shown in FIG. 4 and the neck 16 is lowered onto the filler neck 28 or inlet of the appropriate reservoir 26. The neck 16 is a screw fit into the filler neck 28, and as this axial coupling between the container and the reservoir takes place, the arms 20 on the ring member 14 carried by the container enter the axial slots 30 in the filler neck 28. Provided that the number and position of the arms 20 corresponds with the position of the slots 30, then complete coupling between the container 10 and the reservoir 26 can take place.

As shown above, the container can be a screw mounting upon the vessel, in which case the engagement of the arms with the slots serves primarily to ensure that the correct container is being fitted to the vessel. However, the container can be a simple axial push fit mount upon the vessel, for example where the neck of the vessel has a tapered bore into which the neck of the container fits. In this case it may be desirable for the engagement of the arms and the slots to serve the secondary function of locking the container in place once the arms and slots have been engaged. Thus, the slots 30 can be of a dog leg configuration and the feet of the arms 20 can be turned inwardly to engage the slot 30 in a bayonet type of fitting.

Within the filler neck 28 is a seal piercer 32 which is in the form of a hollow metal tube with its end cut off at an angle so that, as the container 10 is screwed into the filler neck 28, the piercer 32 will pierce the foil seal across the neck to allow the contents of the container 10 to flow into the reservoir 26. It will be appreciated that the piercer should not make contact with the foil seal until the arms 20 have entered the slots 30 and the correct matching of the container to the vessel is assured.

Figure 5:
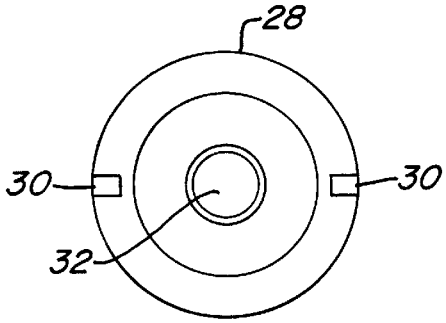
FIG. 5 is a plan view of the neck of the reservoir from FIG. 4.
Figure 9:
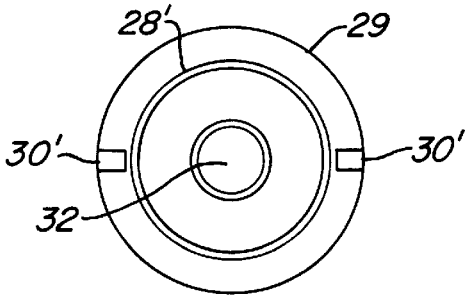
FIG. 9 is another embodiment of the neck of the reservoir, similar to FIG. 4, with the respective corresponding parts thereof designated by primes.

As shown in FIGS. 4 and 5, the slots 30 can be formed as an integral part of the neck 28 of the vessel 26. However, this need not be the case and the slots could be carried on a second ring member (29 in FIG. 9) similar to the ring 14 carried by the neck of container 10. In this case the ring members can be fitted by a user to conventional containers and reservoirs to modify existing equipment to possess the identity means of the invention.

Figure 6:
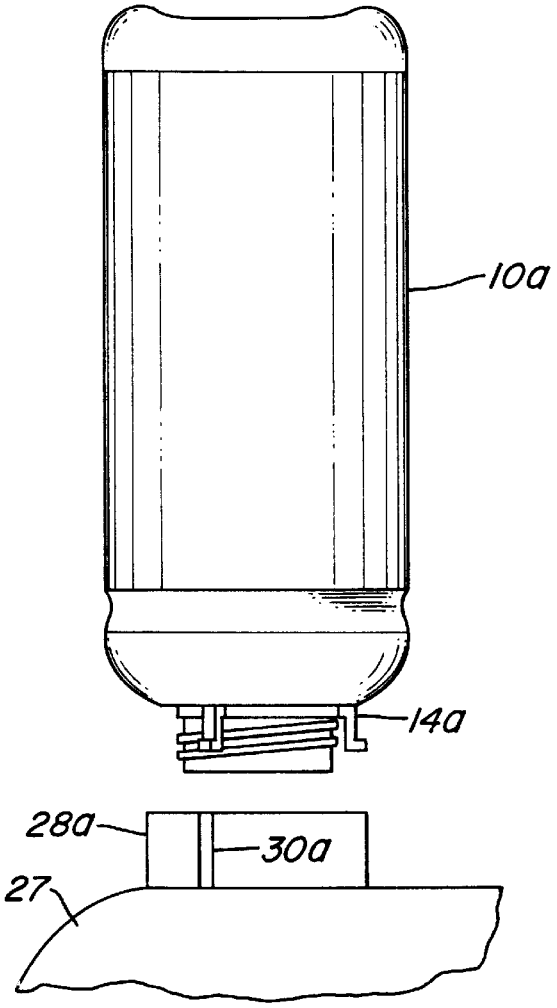
FIG. 6 is a view corresponding to FIG. 4 but showing a different container and different reservoir.
Figure 7:
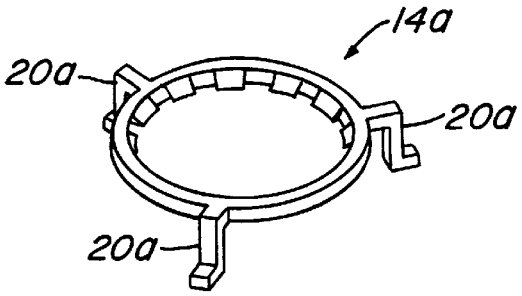
FIG. 7 is a perspective view of the container ring member from FIG. 6.
Figure 8:
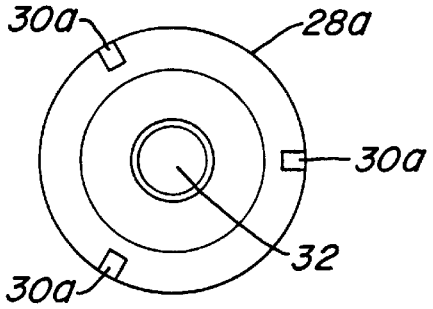
FIG. 8 is a plan view of the reservoir neck from FIG. 6.

FIGS. 6, 7 and 8 show a second reservoir 27. This reservoir is for containing ink rather than top-up fluid, and the filler neck 28*a* has three equi-angularly spaced slots 30*a* which are positioned and dimensioned so as to receive the three arms 20*a* on the register ring 14*a* fitted on the container 10*a* of ink.

Because of the difference between the number and position of the arms 20 and 20*a* on the rings 14 and 14*a* and the number and position of the slots 30 and 30*a,* container 10 cannot be coupled to the filler neck 28*a,* and container 10*a* cannot be coupled to the filler neck 28. The arrangement just described therefore ensures that only the correct container is coupled to the correct reservoir and that an attempt to couple the wrong container to a reservoir will be physically prevented.

Although the embodiment described uses a screw coupling between the container 10*a* and the reservoir 26, 27 the invention can also be applied to a situation where there is a push-in coupling between the two. Where there is a screw-in coupling, it is necessary for either the register ring 14, 14*a* or the outer rim of the neck 28, 28*a* to rotate during the coupling movement.

The ring 14, 14*a* is preferably moulded from plastics and may be colour coded to assist in identifying the correct container for the correct reservoir.

The invention therefore also provides an assembly for modifying the container as well as the combination of a vessel to a container which is to be connected to that vessel so as to discharge a replenishment material from the container to the vessel via an outlet from the container which engages with an inlet to the vessel, characterized in that the said assembly comprises a pair of annular members adapted to be mounted one upon said inlet and the other upon said outlet, at least one of which is adapted to be mounted as a move-able fit upon either the inlet or outlet, the said annular members carrying one or more axially inter-engageable members whereby engagement of the inter-engageable members is required before the container can be secured in flow communication with the vessel.

What is claimed is:

1. An assembly for modifying a combination of a vessel and a container where the container is to be connected to the vessel so as to discharge a replenishment material from the container to the vessel, the container having an outlet and the vessel having an inlet engageable with the container outlet, the assembly comprising:

a first annular member and a second annular member, the first annular member mounted on the vessel inlet and the second annular member mounted on the container outlet;

at least a selected one of the first annular member and second annular member mounted as a move-able fit; and wherein the first and second annular members are provided with axially inter-engageable members, the axially inter-engageable member of the first annular member engaging the axially inter-engageable member of the second annular member as the container is connected to the vessel, whereby replenishment material is discharged from the container to the vessel.

2. An assembly for modifying a combination or a vessel and a container where the container is to be connected to the vessel so as to discharge a fluid from the container to the vessel, the container having an externally threaded neck extending therefrom which forms an outlet for the container and the vessel having an internally threaded neck extending therefrom which forms an inlet engageable with the container outlet, the assembly comprising:

a first annular member and a second annular member, the first annular member mounted on the vessel inlet and the second annular member mounted on the container outlet;

the second annular member which is mounted upon the container outlet mounted as a move-able fit;

wherein the first and second annular members are provided with axially inter-engageable members which extend along an axis generally parallel to a longitudinal axis of the container the axially inter-engageable member of the first annular member engaging the axially inter-engageable member of the second annular member as the container is connected to the vessel, whereby replenishment material is discharged from the container to the vessel; and wherein the second annular member carried by the container has radially inwardly projecting members adapted to engage the externally threaded neck of the container.

3. The assembly of claim 2, wherein the radially inwardly projecting members carried by the second annular member on the neck of the container comprise a series of teeth which are shaped to act as a ratchet as the second annular member is mounted about the externally threaded neck of the container, the teeth being engageable with the externally threaded neck to prevent removal of the annular member once in place.

4. The assembly of claim 3, wherein the second annular member on the neck of the container continues to form a moveable-fit once the ratchet teeth have engaged the externally threaded neck of the container.

5. The assembly of claim 4, wherein the inter-engageable member of the first annular member is integrally formed on the neck of the vessel so that it does not form a moveable fit.

* * * * *